United States Patent [19]

Swan

[11] Patent Number: 4,881,276

[45] Date of Patent: Nov. 21, 1989

[54] REINFORCED COLD WEATHER SPORTS GLOVE

[76] Inventor: Richard L. Swan, 1260 Monroe St., Reno, Nev. 89509

[21] Appl. No.: 187,552

[22] Filed: Apr. 28, 1988

[51] Int. Cl.[4] ..... A41D 19/00

[52] U.S. Cl. ..... 2/161 A; 2/169; 2/167

[58] Field of Search ..... 2/159, 160, 161 A, 161 R, 2/164, 167, 168, 169; 15/227

[56] References Cited

U.S. PATENT DOCUMENTS

| | | | |
|---|---|---|---|
| 709,595 | 9/1902 | Carson | 2/161 R |
| 919,406 | 4/1909 | Warren | 2/168 |
| 1,179,871 | 4/1916 | John | 2/161 R |
| 2,657,391 | 11/1953 | Crandon | 2/161 R |
| 2,728,082 | 12/1955 | Slimovitz | 2/167 |
| 3,094,704 | 6/1963 | Abildgaard | 2/167 |
| 3,098,237 | 7/1968 | Slimovitz | 2/158 X |
| 3,151,333 | 10/1964 | Scholz | 15/227 X |
| 3,235,881 | 2/1966 | Chisholm | 2/167 |
| 3,255,461 | 6/1966 | Bullock | 2/159 |
| 3,341,861 | 9/1967 | Robbins | 2/167 X |
| 3,487,146 | 12/1969 | Tillotson | 2/167 X |
| 3,643,386 | 2/1972 | Grzyil | 15/227 X |
| 3,740,262 | 6/1973 | Agostinelli | 2/159 X |
| 3,934,062 | 1/1976 | Tillotson et al. | 2/167 X |
| 4,064,563 | 12/1977 | Stokes | 2/161 A |
| 4,071,913 | 2/1978 | Rector | 2/20 |
| 4,094,014 | 6/1978 | Schroeder | 2/161 R |
| 4,154,542 | 5/1979 | Rasmason | 15/227 X |
| 4,224,692 | 9/1980 | Sundberg | 2/161 R |
| 4,302,851 | 12/1981 | Adair | 2/158 |
| 4,371,988 | 2/1983 | Berend | 2/167 |
| 4,408,358 | 10/1983 | Swan | 2/161 A |
| 4,507,807 | 4/1985 | Karkanen | 2/161 R |
| 4,540,407 | 9/1985 | Dunn | 2/161 R |
| 4,621,388 | 11/1986 | Ortolivo | 15/227 |
| 4,658,444 | 4/1987 | Figlia et al. | 2/161 X |
| 4,675,914 | 6/1987 | Mitchell | 2/159 X |
| 4,788,733 | 12/1988 | Lerner | 15/227 X |

FOREIGN PATENT DOCUMENTS

| | | | |
|---|---|---|---|
| 956482 | 12/1956 | Fed. Rep. of Germany | 2/167 |
| 061790 | 2/1981 | PCT Int'l Appl. | 2/161 R |

OTHER PUBLICATIONS

Direct Safety Co., Catalog 179-5A ©1979, (Shawnee Mission, Kansas).

*Primary Examiner*—Werner H. Schroeder
*Assistant Examiner*—Jeanette E. Chapman
*Attorney, Agent, or Firm*—Roylance, Abrams, Berdo & Goodman

[57] ABSTRACT

A cold weather sports glove including at least one of the fingers or thumb having an area of low coefficient of friction and at least one opposing finger or thumb having an area of high coefficient of friction. The glove is formed with a layer of compressible neoprene foam rubber which forms the outer surface of the glove having a high coefficient of friction. Nylon pads are coupled to the outer surface of the foam rubber layer at the distal ends of preselected fingers or thumb. The area of low friction, formed by the nylon pads, permits the user to perform activities requiring a relative slipping motion between the user's finger or thumb and the device being used. The area of high friction, formed by the foam rubber layer, permits the user to grasp and release objects with more sensitivity and precision due to its compressibility. In fishing, preferably the thumb and index finger of the glove have areas of low coefficient of friction. In hunting, preferably the index finger of the glove is covered with an area of low coefficient of friction on both its palm and backhand sides. In archery, preferably the index finger, the middle finger and the pinky have areas of low coefficients of friction on their palm side to permit the bowstring to slide thereon when released. In a snowmobile mitt, preferably the index finger has an area of low coefficient of friction, while the thumb and the mitt portions are covered with areas of high coefficients of friction.

18 Claims, 2 Drawing Sheets

REINFORCED COLD WEATHER SPORTS GLOVE

FIELD OF THE INVENTION

The invention relates to cold weather sports gloves having areas of high and low coefficients of friction for improving dexterity for specific manual functions such as casting, handling fishing lines, archery and shooting guns. More specifically, the invention relates to a glove with at least one of the fingers having an area of low coefficient of friction and at least one opposing finger having an area of high coefficient of friction. Thus, the glove permits the user to efficiently perform certain cold weather sporting activities requiring an object or device to slide along the outer surface of a finger of the user.

BACKGROUND OF THE INVENTION

With the increased interest in various sports, more and more of the traditional spring and summer sports are being undertaken during the colder fall and winter months. This calls for additional equipment, such as warm clothing, and especially gloves for protecting the hands while allowing participation in the sporting activity. A specific example is cold weather fishing which requires the fishing line to slide along one's finger when retrieving the fishing line after a cast. In archery, when releasing the bowstring, the bowstring should easily slide along the index finger, middle finger and ring finger for proper release. When hunting with a gun, the index finger should slide smoothly into the trigger housing to avoid misfiring. Thus, in these cases, it is highly advantageous to use a pair of gloves which provide a firm grip, yet also provide a smooth surface having a low coefficient of friction for performing a specific function, such as casting, handling fishing lines, releasing a bowstring, or shooting a gun. Similar requirements are found in other sports or commercial activities.

Numerous cold weather gloves are known in the prior art. However, these cold weather gloves have several disadvantages. For example, many of them are formed of a thick fabric, and thus, they do not provide sufficient gripping power. In addition, many of these prior art gloves do not provide any means for permitting a relative sliding movement of the device being used against the outer surface of the glove. Moreover, the prior art gloves which have a surface of low coefficient of friction fail to provide an opposing finger or thumb with a surface of high coefficient of friction, which can be used with the finger or thumb of low coefficient of friction to permit the user to grasp and release objects with more precision and sensitivity.

An example of the prior art is U.S. Pat. No. 4,408,358 to Swan which discloses a glove formed of an outer rubber layer of closed cell neoprene foam and an inner layer of nylon fabric. This glove requires cutting off the tips of the thumb and index finger of the glove to provide the desired sliding and gripping actions. Other examples of these prior art gloves are disclosed in U.S. Pat. Nos. 919,406 to Warren; 2,728,082 to Slimovitz; 3,255,461 to Bullock; 3,643,386 to Grzyll; 4,064,563 to Stokes; 4,071,913 to Rector; 4,094,014 to Schroeder; 4,302,851 to Adair; and 4,507,807 to Karkanen.

SUMMARY OF THE INVENTION

Accordingly, a primary object of the invention is to provide a cold weather glove with a finger or thumb having an area of low coefficient of friction and an opposing finger or thumb having an area of high coefficient of friction for permitting the user to grip objects with more precision and sensitivity.

Another object of the invention is to provide a glove that is relatively thin for increasing manual dexterity in cold, wet conditions.

Another object of the invention is to provide a glove that permits the sports enthusiast or worker to skillfully perform a number of functions required in various sports or activities.

The foregoing objects are basically attained by providing a cold weather sports glove comprising: a hand portion having a palm side and a backhand side; a plurality of tubular portions, extending from the hand portion for receiving a thumb, an index finger, a middle finger, a ring finger, and a pinky, each having a palm side, a backhand side, and a free distal end; a first of said tubular portions having a first layer of compressible foam material having an outer surface with a high coefficient of friction on its palm side; and a second of said tubular portions having a second layer of compressible foam material with an outer surface on its palm side, and a third layer of flexible material having an outer surface with a low coefficient of friction, the third layer overlying the second layer's outer surface, whereby the first and second layers are compressible to create additional gripping ability by the first of said tubular portions and the second of said tubular portions which permits the user to grasp and release objects with more precision and sensitivity and whereby the third layer provides an enhanced sliding surface to the glove.

Other objects, advantages and salient features of the invention will become apparent from the following detailed description, which, taken in conjunction with the annexed drawings, discloses four embodiments of the invention.

BRIEF DESCRIPTION OF THE DRAWINGS

Referring now to the drawings, which form part of this original disclosure.

DETAILED DESCRIPTION OF THE INVENTION

Figure 1:
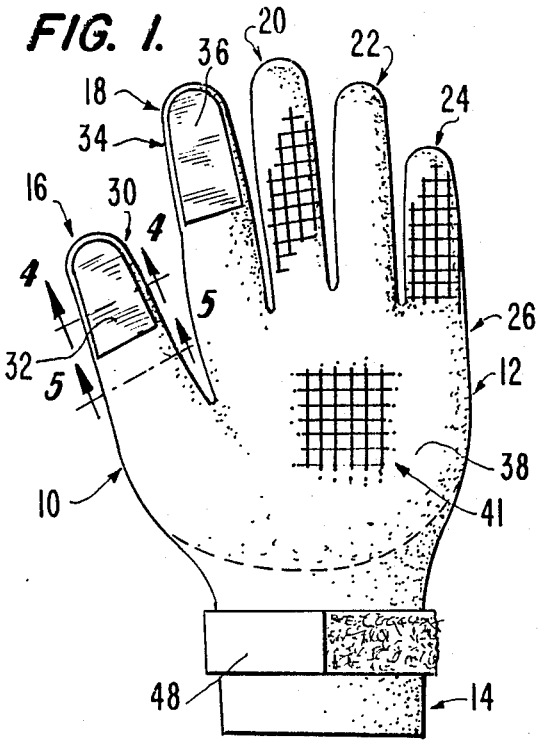
FIG. 1 is a bottom plan view showing the palm side of a sports glove in accordance with the present invention.
Figure 2:
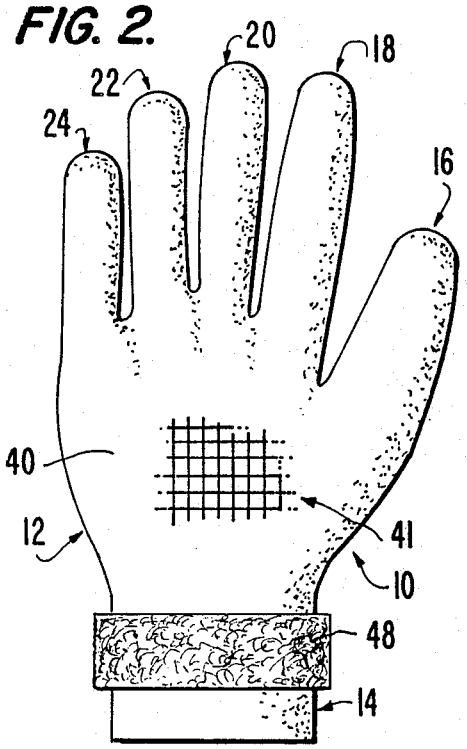
FIG. 2 is a top plan view showing the backhand side of the sports glove shown in FIG. 1 in accordance with the present invention.

As seen in FIGS. 1 and 2, the cold weather sports glove 10 in accordance with the invention comprises a tubular hand portion 12, a tubular wrist portion 14, and a plurality of tubular portions including a tubular thumb portion 16, a tubular index finger portion 18,. a tubular middle finger portion 20, a tubular ring finger portion 22 and a tubular pinky portion 24 constructed by using conventional glove making methods. These portions of the glove are preferably all formed with an outer layer 26 of neoprene rubber and an inner layer 28 of nylon fabric. The thumb and finger portions all have closed distal ends.

As seen in FIG. 1, the tubular thumb portion 16 at its distal end 30 on the palm side includes a resilient nylon pad 32 coupled thereto. Likewise, the tubular index finger portion 18 at its distal end 34 on the palm side includes a resilient nylon pad 36 coupled thereto. These nylon pads 32 and 36 are formed of nylon fabric or other suitable woven cloth having a thickness of about 0.1 to 0.3 millimeter and are coupled to the outer layer by conventional glove making methods, such as by pressing with, a hot iron or gluing. Nylon pads 32 and 36 have a low coefficient of friction, thus allowing objects or..devices to readily slide thereon and also preventing the neoprene rubber of the outer layer 26 from wearing out. Also in this embodiment the middle finger portion 20, the ring finger portion 22, and the pinky portion 24 are all free from any nylon pads, and thus have a high coefficient of friction due to neoprene rubber of the outer layer 26.

Figure 3:
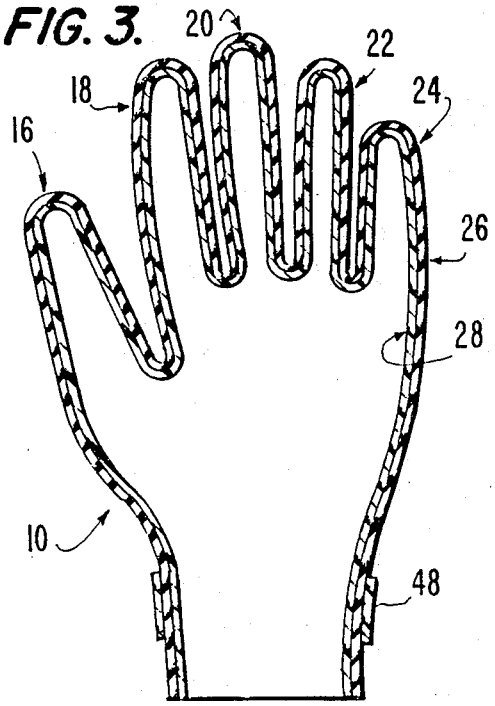
FIG. 3 is a bottom plan longitudinal sectional view of the glove shown in FIGS. 1 and 2.
Figure 4:
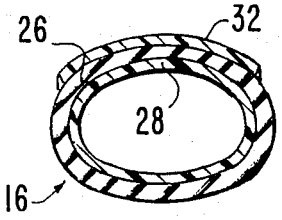
FIG. 4 is a side elevational view in transverse section taken along line 4—4 in FIG. 1 showing the thumb portion of the glove and a pad of nylon fabric coupled thereto.
Figure 5:
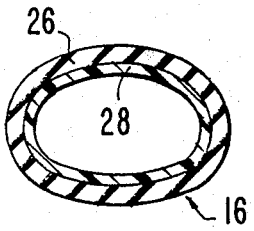
FIG. 5 is a side elevational view in transverse section taken along line 5—5 in FIG. 1 showing the thumb portion of the glove in an area which is free of the nylon pad.

As seen in FIGS. 3–5, preferably the outer layer 26 and the inner layer 28 extend throughout the entire glove 10. These layers are resilient and stretchable. The outer layer 26 of the glove 10 is preferably formed of a closed cell neoprene foam rubber having a thickness in the range of about 1.5 to about 4.0 millimeters. The inner layer 28 is preferably formed of nylon fabric and has a thickness of about 0.1 to 0.3 millimeter. In this embodiment, both the palm side 38 and the backhand side 40 of the glove 10 have their entire outer layer 26 formed with a contoured surface 41.

Figure 6:
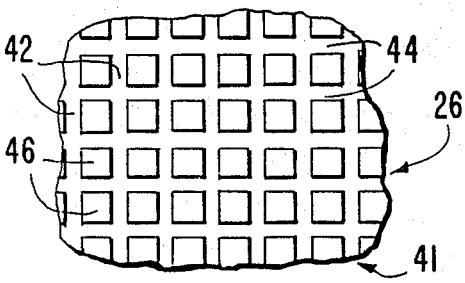
FIG. 6 is a fragmentary, enlarged plan view of the surface of the glove in FIGS. 1 and 2 showing the contoured surface.

As seen in FIG. 6, the contoured outer, surface 41 of the outer layer 26 includes a plurality of grooves 42 extending in a first direction and a plurality of grooves 40 extending in a direction perpendicular to grooves 44. These grooves 42 and 44 form a plurality of raised portions 46. This increases the coefficient of friction of the outer surface 26 of the neoprene rubber to increase the user's gripping ability. In future embodiments, these grooves could be more or less pronounced to increase or decrease friction according to the specific need of user.

Figure 6A:
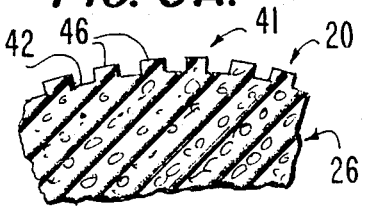
FIG. 6A is an enlarged, diagrammatic, fragmentary side elevational view of a middle finger portion in transverse section showing the raised contour portions and the closed cells in the foam rubber layer.
Figure 6B:
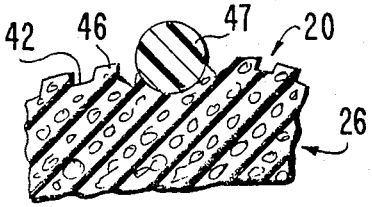
FIG. 6B is a view similar to that shown in FIG. 6A except that a fishing line is being pressed against the foam rubber layer, thereby compressing the layer and increasing the surface area in contact with the fishing line.

The outer layer 26 is soft, compressible and has a high coefficient of friction for permitting the user to grasp objects. The nylon pads 32 and 36 are smooth and have a low coefficient of friction for permitting the user to perform specific functions. Very delicate tasks, such as grasping fishing lines, can be performed by closing the tubular thumb portion 16 having nylon pad 32 thereon against the tubular middle finger portion 20, which is covered with the contoured foam rubber outer layer 26. The closed cell foam rubber outer layer 26 compresses as seen by comparing FIGS. 6A and 6B, creating additional gripping ability between the thumb portion 16 and the tubular middle finger portion 20. When grasping an object or a device such as fishing line 47 in FIG. 6B, the foam rubber outer layer 26 compresses about the object or device, thereby increasing the surface area of the glove that comes in contact with the object or device and thus the frictional contact therebetween. By varying the pressure of the glove against the object or device being grasped, the user can vary the amount of surface area of the glove that comes into contact with the object or device. Thus, the range of dexterity is increased over prior art gloves due to the compressibility of the outer layer 26 and the nylon pads 32 and 36 having a low coefficient of friction. A fly fishing line pulled between the surfaces of two of the nylon pads has a coefficient of friction (C.F.) of 0.18. When the same line is pulled between one nylon pad and a piece of the contoured rubber foam, it has a C.F. of 0.47. When the same line is pulled between two surfaces of the contoured rubber foam, it has a C.F. of 0.72.

As seen in FIGS. 1 and 2, a wrist strap 48, preferably formed of non-stretchable nylon, is rigidly coupled at one end, such as by stitching, to the wrist portion 14 of the glove and has Velcro eye fasteners on its outside surface and a series of Velcro hook fasteners on its inside surface near the free end. Accordingly, the wrist strap 48 can be tensioned around the wearer's wrist to aid in sealing the wrist of the glove. A more detailed description of the wrist strap 48 is provided in the applicant's prior U.S. Pat. No. 4,408,358 which is hereby incorporated herein by reference.

SECOND EMBODIMENT OF FIGS. 7–8

Figure 7:
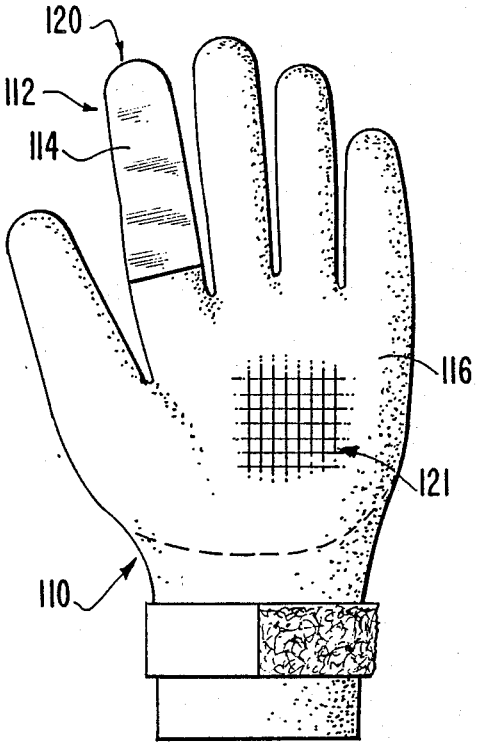
FIG. 7 is a bottom plan view of the palm side of a second embodiment of a sports glove in accordance with the present invention.
Figure 8:
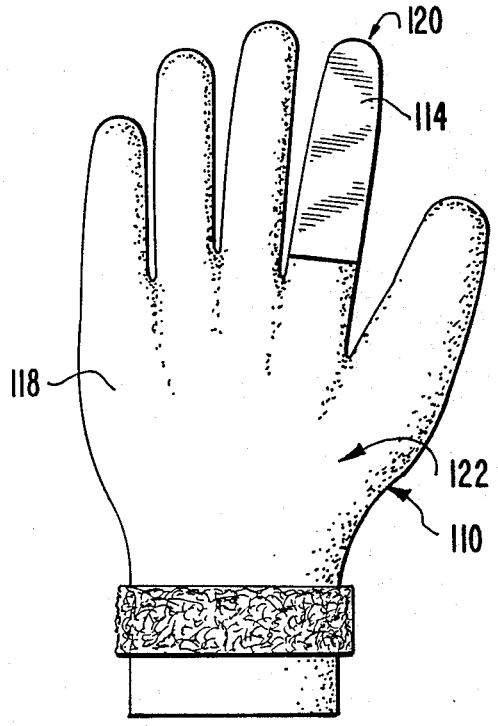
FIG. 8 is a top plan view of the backhand side of a second embodiment of the sports glove in accordance with the present invention.

As seen in FIGS. 7 and 8, the glove 110 is essentially the same as the glove 10 of FIGS. 1–6, except only the tubular index finger portion 112 has a nylon pad 114 coupled to both the palm side 116 and the backhand side 118 of the glove 110. Also, only the palm side 116 has a contoured outer surface 121, while the backhand side 118 has a smooth outer surface 122.

The glove 110 is specifically designed for hunting with a gun. However, it should be understood that glove 110 can be used for other activities if desired. By covering the distal end 120 of the tubular index finger portion 112 with nylon pad 114 on both sides, the user is able to smoothly slide the index finger portion 112 into the trigger housing without obstruction.

THIRD EMBODIMENT OF FIG. 9

Figure 9:
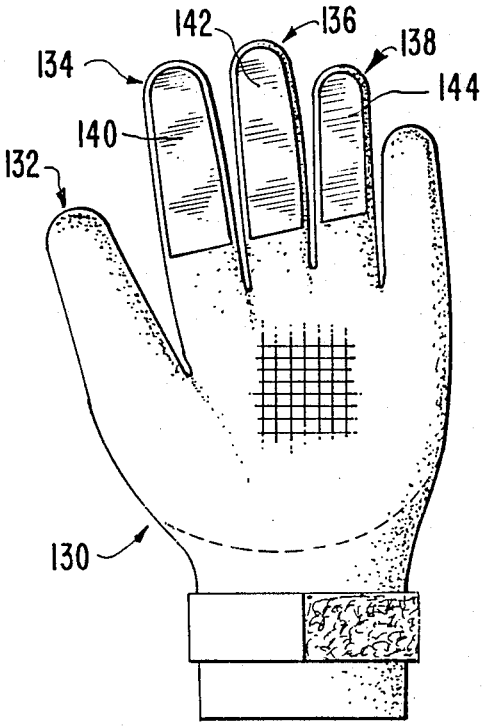
FIG. 9 is a bottom plan view of the palm side of a third embodiment of a sports glove in accordance with the present invention.

As seen in FIG. 9, the glove 130 is essentially the same as the glove 10 of FIGS. 1–6, except the thumb portion 132 is free from any nylon pads, and the tubular index, finger portion 134, the tubular middle finger portion 136, and the tubular ring finger portion 138 each includes a nylon pad 140, 142, and 144, respectively, on its palm side.

The glove 130 is specifically designed for archery. However, it should be understood that glove 130 can be used for other activities if desired. By covering the tubular index finger portion 134, the tubular middle finger portion 136, and the tubular ring finger portion 138 with nylon pads 140, 142 and 144, respectively, the bowstring can slide smoothly thereon, providing smooth release.

FOURTH EMBODIMENT OF FIG. 10

Figure 10:
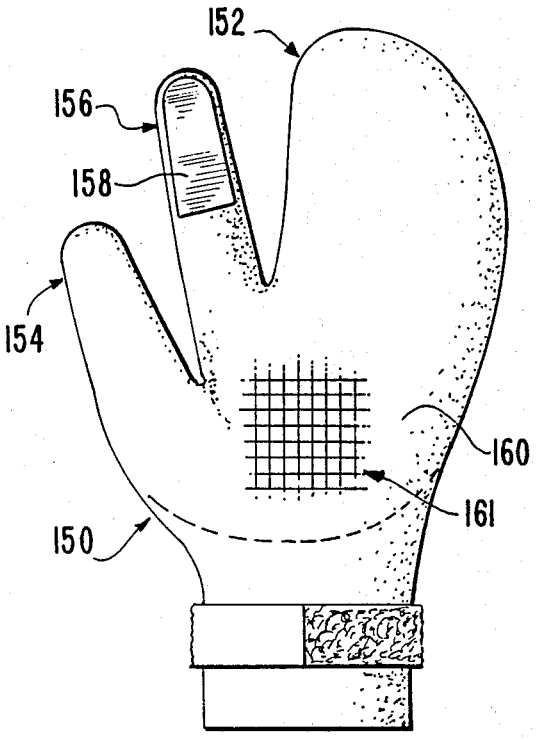
FIG. 10 is a bottom plan view of the palm side of a fourth embodiment of a sports glove in accordance with the present invention.

As seen in FIG. 10, the glove 150 is essentially the same as glove 10 of FIGS. 1–6, except that a single tubular portion 152 is provided to receive the middle finger, the ring finger and the pinky finger of a user. Also, the tubular thumb portion 154 is free from any nylon pads while only the palm side of the tubular index finger portion 156 has a nylon pad 158 coupled thereto. The palm side 160 of the glove 150 has a contoured outer surface 161 like the glove 10 of FIGS. 1–6; however, the backhand side (not shown) of glove 150 may have either a contoured or a smooth outer surface.

The glove 150 is designed for activities, such as snowmobiling, or ice fishing where the user requires a warmer glove.

It should be understood that this glove could be provided with fold-down fingers as is known in the prior art.

While only four embodiments have been chosen to illustrate the invention, it will be understood by those skilled in the art that various changes and modifications can be made therein without departing from the scope of the invention as defined in the appended claims.

Also, it will be understood that although the present embodiments are constructed using conventional glove making techniques, all or any part of the glove could be molded in one operation without departing from the scope of the invention as defined in the appended claims.

What is claimed is:

1. A sports glove comprising:

a hand portion having a palm side and a backhand side;

a plurality of tubular portions, extending from said hand portion, for receiving a thumb, an index finger, a middle finger, a ring finger and a pinky, each having a palm side, a backhand side and a free distal end;

a first of said tubular portions having a first layer of compressible foam material having an outer surface with a high coefficient of friction on its palm side; and a second of said tubular portions having a first layer of compressible foam material with an outer surface on its palm side, and an additional layer of flexible material having an outer surface with a low coefficient of friction, said additional layer overlying said first layer's outer surface of said second tubular portion, whereby said first layers of said first and second tubular portions are compressible to create additional gripping ability by said first tubular portion and said second tubular portion which permit the user to grasp and release objects with more precision and sensitivity and whereby said additional layer provides an enhanced sliding surface to the glove.

2. A sports glove according to claim 1, wherein each of said first layers of said first and second tubular portions have inside surfaces, and further including an inner layer of material having a low coefficient of friction coupled to each of said first layer's inside surfaces.

3. A sports glove according to claim 2, wherein each of said inner layers is formed of nylon fabric.

4. A sports glove according to claim 2, wherein said inner layers are coupled to said first layer via pressing.

5. A sports glove according to claim 1, wherein said first layer is formed of closed cell neoprene foam rubber.

6. A sports glove according to claim 1, wherein said additional layer is formed of nylon fabric.

7. A sports glove according to claim 1, wherein said first and second tubular portions are positioned to receive a thumb and an index finger, respectively.

8. A sports glove according to claim 1, wherein said additional layer also overlies said backhand side of said second tubular portion.

9. A sports glove according to claim 7, wherein said second tubular portion is positioned to receive an index finger.

10. A sports glove according to claim 1, including a third of said tubular portions having a first layer of compressible foam material with an outer surface on its palm side, and an additional layer of flexible material having an outer surface with a low coefficient of friction, said additional layer of said third tubular portion overlying said first layer's outer surface of said third tubular portion.

11. A sports glove according to claim 10, wherein said second and third tubular portions are positioned to receive a thumb and an index finger, respectively.

12. A sports glove according to claim 1, including a third of said tubular portions having a first layer of compressible foam material with an outer surface on its palm side, and an additional layer of flexible material having an outer surface with a low coefficient of friction, said additional layer of said third tubular portion overlying said first layer's outer surface of said third tubular portion;

a fourth of said tubular portion having a first layer of compressible foam material with an outer surface on its palm side, and an additional layer of flexible material having an outer surface with a low coefficient of friction, said additional layer of said fourth tubing portion overlying said first layer's outer surface of said fourth tubular portion.

13. A sports glove according to claim 12, wherein said first, second, third and fourth tubular portions are positioned to receive the thumb, index finger, middle finger and ring finger, respectively.

14. A sports glove according to claim 1, wherein said first layers are formed of a neoprene foam rubber having a contoured outer surface on their palm side.

15. A sports glove according to claim 14, wherein said first layers are further formed of a neoprene foam rubber having a smooth outer surface on their backhand side.

16. A sports glove according to claim 1, wherein said first layers are in the range of about 1.5 mm to about 4.0 mm in thickness.

17. A sports glove according to claim 1, including a third of said tubular portions positioned and sized to receive the middle finger, ring finger and pinky therein.

18. A sports glove according to claim 17, wherein said first and second tubular portions are positioned to receive the thumb and index finger, respectively.

* * * * *